US006935583B2

(12) United States Patent
Mauchle

(10) Patent No.: US 6,935,583 B2
(45) Date of Patent: Aug. 30, 2005

(54) COATING-POWDER SPRAY GUN

(75) Inventor: Felix Mauchle, Abtwill (CH)

(73) Assignee: ITW Gema AG, St. Gallen (CH)

( * ) Notice: Subject to any disclaimer, the term of this patent is extended or adjusted under 35 U.S.C. 154(b) by 297 days.

(21) Appl. No.: 10/270,049

(22) Filed: Oct. 15, 2002

(65) Prior Publication Data

US 2003/0071143 A1 Apr. 17, 2003

(30) Foreign Application Priority Data

Oct. 13, 2001 (DE) ..... 101 50 759

(51) Int. Cl.[7] ..... B05B 5/00; F23D 11/32
(52) U.S. Cl. ..... 239/690; 239/708; 239/600
(58) Field of Search ..... 239/690

(56) References Cited

U.S. PATENT DOCUMENTS

| | | | | |
|---|---|---|---|---|
| 3,599,038 A | | 8/1971 | Skidmore | |
| 3,731,145 A | | 5/1973 | Senay | |
| 3,902,108 A | * | 8/1975 | Sion | 363/61 |
| 4,196,465 A | | 4/1980 | Buschor | |
| 4,529,131 A | * | 7/1985 | Rutz | 239/690 |
| 4,752,034 A | * | 6/1988 | Kuhn et al. | 239/690 |
| 4,993,645 A | | 2/1991 | Buschor | |
| 5,184,276 A | * | 2/1993 | Simon | 361/228 |
| 5,199,650 A | * | 4/1993 | Ishibashi et al. | 239/691 |
| 5,720,436 A | * | 2/1998 | Buschor | 239/706 |
| 5,759,271 A | * | 6/1998 | Buschor | 118/308 |
| 2003/0006321 A1 | * | 1/2003 | Mather | |

FOREIGN PATENT DOCUMENTS

| | | | |
|---|---|---|---|
| DE | 32 43 447 | 6/1984 | |
| DE | 35 45 885 | 1/1987 | |
| DE | 40 20 289 | 12/1991 | |
| EP | 0 756 899 | 2/1997 | |
| EP | 0 779 105 | 6/1997 | |
| FR | 2219624 | 9/1974 | |
| FR | 2 599 281 | 12/1987 | |
| FR | 2683162 | 5/1993 | |
| FR | 2683162 A1 * | 5/1993 | B05B/5/025 |

* cited by examiner

*Primary Examiner*—David A. Scherbel
*Assistant Examiner*—James S. Hogan
(74) *Attorney, Agent, or Firm*—Lowe Hauptman & Berner, LLP

(57) ABSTRACT

A coating-powder spray gun includes a gun housing (2) of which the front end face is sealed pressure-hermetically with respect to compressed gas by a front end wall (28). A current-limiting resistor (32) and at least a portion of a high-voltage generator (10) are potted in an integral electrically insulating block. The potted block may be received in the gun housing (2).

20 Claims, 2 Drawing Sheets

COATING-POWDER SPRAY GUN

FIELD OF THE INVENTION

The invention relates to a coating-powder spray gun.

BACKGROUND OF THE INVENTION

U.S. Pat. No. 5,759,271 (=EP 0 779 105 A1) shows a coating powder spray gun of this kind. It comprises a gun housing fitted with a tubular powder feed duct, a high-voltage chamber and further chambers all issuing openly from a rear end face of the gun housing. This document however remains silent whether the chambers are open or closed in the front end face of the gun housing. Gun housings of this kind known in practice are open at the front and at the rear. Practical designs most of the time call for a current limiting resistor between the high-voltage side of the high-voltage generator and the electrical contact in order to limit the high-voltage electrode's short-circuit current. The known powder spray gun may be affixed to a robot arm or on a support or another displaceable or immobile device.

A spray gun of a similar kind is known from U.S. Pat. No. 4,993,645 and includes a grip for manual handling.

A coating-powder spray gun used as a manual gun or as a machine-mounted gun is known from the U.S. Pat. No. 4,196,465. This document furthermore discloses details regarding a high-voltage generator received within the gun. Such a generator moreover may be configured outside the gun. Typically such a generator includes an oscillator converting a low input voltage into a low AC voltage, also a transformer connected to the AC output to transform up the said AC voltage and a cascade circuit containing a rectifier and capacitors or similar components to further raise the electrical voltage and to convert it into a high DC voltage for instance in the range from 2,000 to 170,000 v to be applied to one or more electrodes of said gun to electrostatically charge the coating powder.

The coating powder contains not only large powder particles, but also micro powder particles. The latter tend to penetrating the chambers at the front end face of the gun housing. As a result leakage currents, shorts and arcing from the high-voltage paths to the other components at lower potentials, for instance at ground, may occur, especially when the coating powder is electrically conducting or contains conducting components.

SUMMARY OF THE INVENTION

The objective of the present invention is to prevent or at least substantially reduce both the penetration of coating-powder particles into the front ends of chambers that are subtended by the gun housing and the entailed drawbacks.

Accordingly the invention relates to a coating-powder spray gun containing an integral plastic gun housing fitted with an end face that is open at the rear, further containing one tubular powder-feed duct each starting from said end face and issuing from a front end face of the gun housing while constituting a high-voltage chamber into which a high-voltage generator is inserted in the longitudinal gun direction through the rearward-open end face to generate a high voltage for at least one high-voltage electrode for the purpose of electrostatically charging the coating powder, said spray gun being characterized in that the high-voltage chamber is sealed at the front end of the gun housing by this housing and in that at least one electrical jumper lead runs in pressure-hermetic manner through said gun housing, said jumper being electrically connected within the high-voltage chamber to the high-voltage terminal of the high-voltage generator, where moreover it is connected outside the gun housing with an electrically conducting electrode jumper for the purpose of applying a high voltage to said high-voltage electrode.

Accordingly the front end of the high-voltage chamber is fully sealed by the material of the gun housing itself. The minimum of one electrode jumper at the high-voltage output of the high-voltage generator passes pressure-hermetically sealed through the gun housing. Said jumper may either hermetically rest against the gun housing material or it may be sealed by a pressure-hermetic seal at the gun housing. In the invention, the interface between the front end segment of the gun housing is shifted as far as the front end of the gun housing. As a result the danger that leakage currents or electrical arcing should arise are averted far more effectively than in the state of the art.

A particular embodiment must be stressed, wherein a high-voltage generator and at least one high-voltage current-limiting resistor are cast, i.e. potted into an electrically insulating hull-shaped preferably plastic dish, the potting material also being electrically insulating, preferably a plastic. The assembly of half-dish and potted component may be inserted from the rear end face of the gun housing into latter's high-voltage chamber, and may be exchanged from it. The gun housing constitutes a sliding seat and provides longitudinal guidance along the gun direction for said assembly. Insulating interfaces between the high-voltage generator and the minimum of one current limiting resistor are entirely avoided in this design as far as the front end of the gun housing.

BRIEF DESCRIPTION OF THE DRAWINGS

The invention is elucidated below in relation to the drawings and by means of an illustrative preferred embodiment.

DETAILED DESCRIPTION OF THE PREFERRED EMBODIMENT

Figure 1:
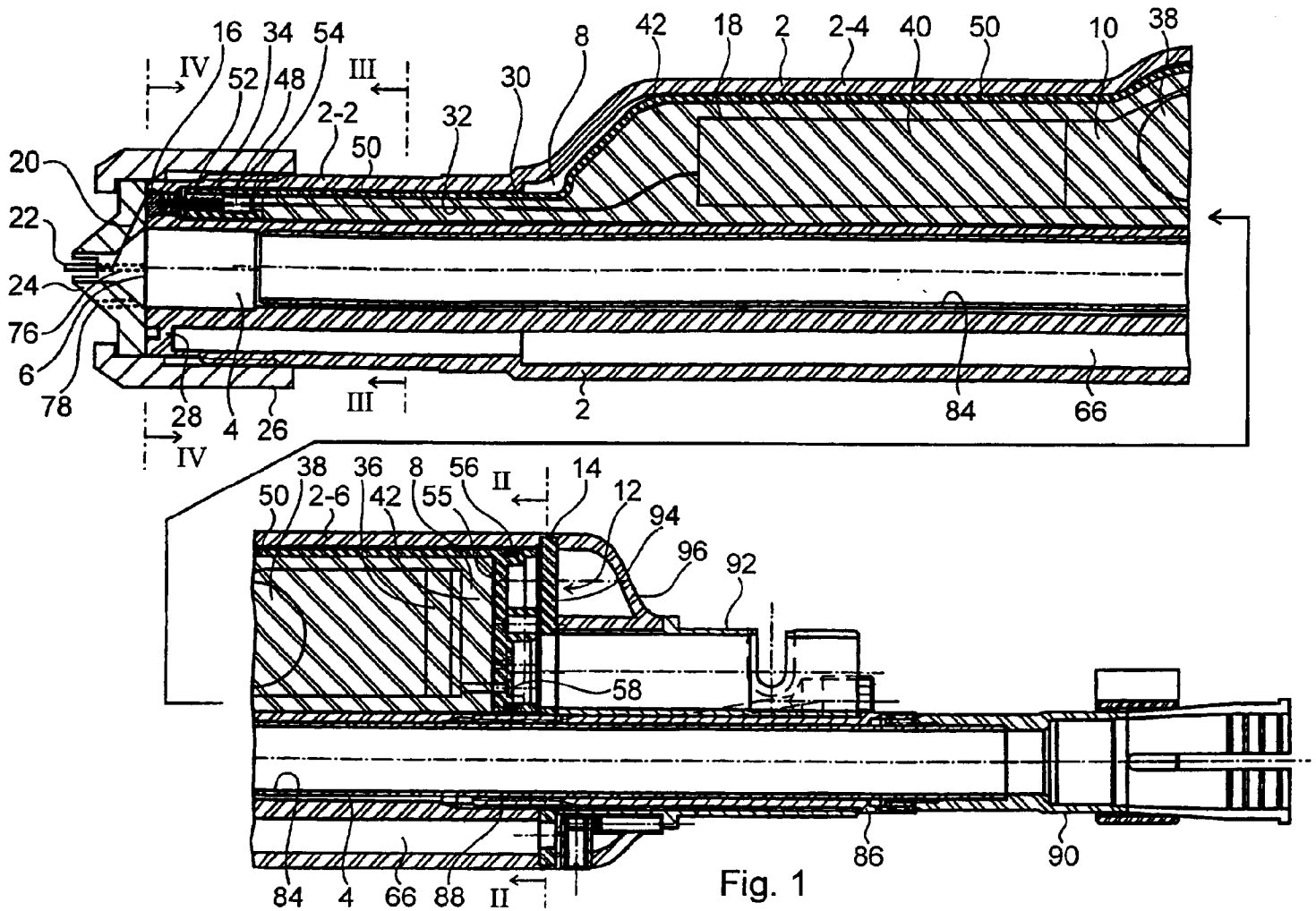
FIG. 1 is a longitudinal section of the powder-coating spray gun of the invention.
Figure 2:
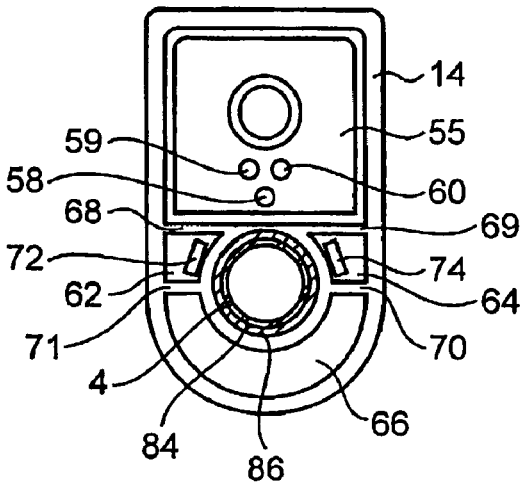
FIG. 2 is a rear elevation of a gun housing of the powder spray gun of FIG. 1 in the plane II—II of FIG. 1, the high-voltage generator, the powder duct and the hollow screw being inserted from the rear into the gun housing.
Figure 3:
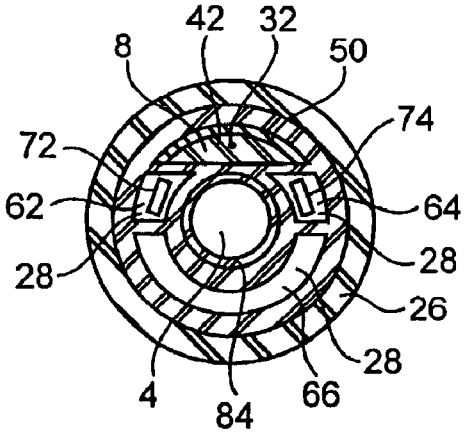
FIG. 3 is a cross-sectional elevation in the plane III—III of FIG. 1.
Figure 4:
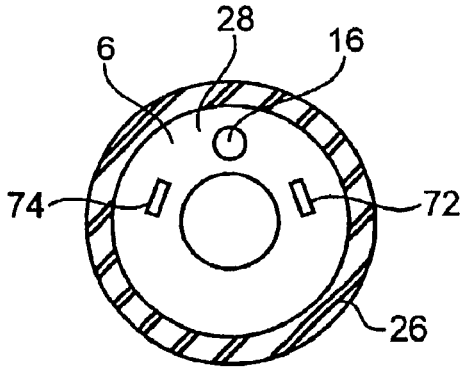
FIG. 4 is a front elevation of the gun housing in the plane IV—IV of FIG. 1.

The coating-powder spray gun of the invention shown in the drawings contains an integral, electrically insulating plastic gun housing 2 preferably made by injection molding. The gun housing 2 subtends a tubular powder-feed duct 4 within a continuous block of material, said duct running in the longitudinal gun direction and issuing at a front end face 6 of the gun housing 2, further a high-voltage chamber 8 extends in the longitudinal gun direction through said housing and is fitted with an intake aperture 12 in the rear end face 14 serving to insert a high-voltage generator 10.

The high-voltage chamber 8 is pressure-hermetically sealed along its full circumference and at the front end face 6 of the gun housing 2 by this very housing. An electric jumper 16 runs through the gun housing 2 and is or may be electrically connected in conducting manner within the high-voltage chamber 8 to the high-voltage terminal 18 of the high-voltage generator 10 and outside the gun housing 2 it is or may be connected by an electric jumper 20 to at least one high-voltage electrode 22 electrode in order to apply high voltage with which to electrostatically charge the coating powder.

The electric jumper 16 and the electrode jumper 20 may be soldered to each other or be plugged into each other or be connected in some other way. Preferably however both shall be contacts that can be made to touch. The electrode jumper 20 for instance may be fitted with a slip ring so that it may be contacted with the jumper 16 regardless of its rotational position. The electrode jumper 20 and the minimum of one high-voltage electrode 22 may be configured in various ways in parts of the spray gun.

In merely illustrative manner, FIG. 1 shows one of many designs of a spray nozzle 24 bearing the electrode jumper 20 and the minimum of one high-voltage electrode 22. The spray nozzle 24 is affixed for instance by a coupling nut 26 that may be screwed by its front segment to the gun housing.

According to the preferred embodiment, the gun housing 2 constitutes at the front end segment and at the front end face a front end wall 28 which is integral with it and which pressure-hermetically bounds the high-voltage chamber 8 at the front end face 6 through which the electric jumper 16 passes in pressure-hermetically manner.

The high-voltage terminal 18 of the high-voltage generator 10 is electrically connected by an electrically high-voltage conducting path 30 comprising a current limiting resistor 32 or several current limiting resistors and an electrically conducting spring 34, preferably a compression spring which presses against the inside of the electrical jumper 16 and makes electrical contact with it.

Illustratively the high-voltage generator 10 consists of an oscillator 36 converting a low DC input voltage into an AC voltage, of a transformer 38 for transforming up this AC voltage, and a cascade circuit 40 or another electrical circuit to generate the DC high-voltage from the AC voltage of the transformer 38 to apply it to the minimum of one high-voltage electrode 22. In manner known per se, the cascade circuit 40 may contain cascaded rectifiers and resistors.

The current limiting resistor 32 and the high-voltage generator 10 are potted into a block 42 of electrically insulating material, preferably plastic, which extends to the vicinity of the spring 34 or near the front end wall 28.

The minimum of one current limiting resistor 32 is situated in a front end segment 2—2 of the gun housing 2 which exhibits a substantially smaller diameter than does central housing segment 2-4 receiving the cascade circuit 40. The rear housing segment 2-6 receives the transformer 38 and the oscillator 36 where called for may exhibit a larger diameter than does the central housing segment 2-4. In this manner the weight of plastic required for the gun housing 2 and the potting material constituting the block 42 shall be reduced to a minimum in each segment. As a result the weight of the global spray gun also is reduced to the minimum. FIG. 1 shows a scaled enlargement of a present powder spray gun of the invention.

The compression spring 34 is situated between the plastic block 42 and the front end face 28 of the gun housing and is kept as short as possible, for instance being only 0.5 cm long, and it is clamped in the longitudinal gun direction between the jumper 16 and an electrically conducting contact head 48, said contact being electrically connected to a downstream terminal of the current limiting resistor 32.

In a preferred embodiment of the invention, a ship hull-shaped half dish 50 made of an electrically insulating material, preferably plastic, is used, the minimum of one current limiting resistor 32 and preferably the full high-voltage generator 10 being potted into the plastic of the block 42. This involves in particular the cascade circuit 40 and preferably also the transformer 38 and preferably also the oscillator 36. The potted plastic block 42 is potted into the hull-shaped half dish 50.

In another preferred embodiment, the half dish 50 is configured at its front end segment, ahead of the minimum of one current limiting resistor 32, as a tubular duct 52 into which the compression spring 34 is inserted at least partly from the front and against which the contact head 48 rests against a forward-pointing duct which is offset in order the axially stress the compression spring 34 between the contact head 48 and the jumper 16.

The hull-shaped half dish subtends at its rear end a cross-wall 55 which, jointly with the dish base and the dish side-walls extends across the full cross-section of the high-voltage chamber 8 and rests in sealing manner against said chamber's entire inside peripheral surface and preferably is sealed additionally by at least one sealing element 56.

Electrical connection elements 58, 59, 60, for instance connecting pins for the low-voltage hookup of an external cable to the oscillator 36 pass in feedthrough and pressure-hermetic manner through the cross-wall 55 of the hull-shaped half dish 50.

The integral and wholly continuous gun housing 2 in addition to the high-voltage chamber 8 also subtends at least one, preferably at least two, or, as shown in the drawings, three adding chambers 62, 64 and 66 and partitions 68, 69 70 and 71 separating said adding chambers and configured in regular manner around the tubular powder feed duct 4 and extending each from the open rear end face 14 of the gun housing 2 as far as a front cross-wall of the gun housing 2, said cross-wall preferably being the cross-wall 28 extending over all chambers and tightly sealing them.

At least one of the adding chambers—in the case of the shown embodiment mode these are the two adding chambers 62 and 64 mounted to the left and to the right next to the tubular powder feed duct 4—are compressed-gas ducts to feed compressed gas, for instance compressed air, from the rear end of the gun housing 2 by means of transmission apertures 72 and 74 resp. in the front end wall 28 to an adjoining pressure-pressure-hermetic compressed-air duct 76 from which compressed air flows over the minimum of one high-voltage electrode 22 in order to keep said electrode (s) free of powder particles and in order to transfer their electric charges to the powder particles.

In some applications moreover the jet or cloud of powder sprayed by the spray gun shall be shaped into a fan jet or another shape. For that or another purpose, another adding duct 64 may be used as a compressed-gas duct of which the compressed gas, for instance compressed air, moves through an aperture 74 in the end wall 28 to one or several compressed-air ducts 78 from which thereupon the compressed air/gas flows onto sprayed jet of coating powder.

As shown in FIG. 1, the compressed-gas ducts 76 and/or 78 may be constituted in the nozzle 24. In other embodiment modes they may be constituted in another element of the powder spray gun. Moreover the minimum of one high-voltage electrode 22 may be configured radially instead of axially in the nozzle 24 or in another component, for instance also in the front end segment of the gun housing 2 or at the rim of the tubular powder feed duct 4.

The drawings' lower addition duct 66 also may be used for feeding compressed air or another fluid or it may remain unused. In all instances the adding chambers 62, 64, 66 and the partitions 68, 69, 70, 71 between all chambers 8, 62, 64, 66 constitute—radially relative to the longitudinal gun direction—an electrically insulating path to preclude electrical leakage currents or arcing. They offer the advantage furthermore that the partitions and also the outside surface of the gun housing 2 may be made very thin and hence be very economical of material and nevertheless they shall offer high mechanical strength, rigidity and be electrically insulating. Preferably the chambers 8, 62, 64 and 66 are configured in regular manner around the entire circumference of the tubular powder-feed duct 4.

The tubular powder feed duct 4 may be used directly as a powder feed duct. However, according to the preferred embodiment of the present invention, a powder tube 84 shall be exchangeably inserted into said duct 4. Said powder tube 84 when eroded by the powder particles of the coating powder or, when being cleaned may then be replaced/exchanged. Said tube 84 also may be made of a more abrasion-resistant plastic or another more abrasion-resistant electrically insulating material than the gun housing 2. Again, the powder tube 84 may be designed and used to generate friction electricity due to the coating powder's particles rubbing against it. In this manner and on account of the exchangeability of the high-voltage generator 10 or the potted half dish 50, the powder spray gun while employing the same gun housing 2 may be matched to different requirements during powder coating.

The powder tube 84 may be affixed in arbitrary manner, for instance using a hollow screw 86 engaging an inside thread 88 at the rear end of the tubular powder feed duct 4 of the gun housing 2 and passing through the powder tube 84 fitted with an axial slide seat. At its rear end, the powder tube 84 may be fitted with an adapter 90 to affix a powder hose.

An adapter 92 to hook up an omitted low-voltage cable may be affixed to the rear end of the gun housing 2 by means of which a low electric voltage may be applied through the connector pins 58, 59 and 60 to the high-voltage generator 10. The adapter 92 also may be affixed by the hollow screw 86 or by other means to the rear end face 14 of the gun housing 2, for instance it may be clamped by the hollow screw 86 against the rear end face 14. A sealing plate 94 and a transition part 96 may be mounted between the adapter 92 and the rear end face 14 of the gun housing 2 to match the external shape of the gun housing 2 to the external shape of the adapter 92.

What is claimed is:

1. A coating-powder spray gun comprising an integral plastic gun housing having a rear open end and a front end;

a high-voltage generator;

a tubular powder-feed duct and a high-voltage chamber both running in a longitudinal direction of said gun from the rear open end of said housing, said tubular powder-feed duct issuing into the front end of the gun housing, and said high-voltage chamber receiving said high-voltage generator which is inserted in the longitudinal direction through the rear open end of said housing;

at least one high-voltage electrode to which a high voltage generated by said high-voltage generator is applied to electrostatically charge the coating powder; and at least one electric jumper and an electrically conducting electrode jumper;

wherein the high-voltage chamber is sealed at the front end of the gun housing by said gun housing;

said at least one electric jumper passes in pressure-hermetic manner through the front end of the gun housings;

the jumper is electrically connected or connectable within the high-voltage chamber to a high-voltage terminal of the high-voltage generator and is connected or connectable outside the gun housing to said electrically conducting electrode jumper for applying the high voltage from the high-voltage terminal to the high-voltage electrode.

2. The powder spray gun as claimed in claim 1, wherein at the front end, the gun housing has an integral front end wall which pressure-hermetically seals the high-voltage chamber and through which the electric jumper passes pressure-hermetically.

3. The powder spray gun as claimed in claim 1, further comprising at least one current-limiting resistor which is mounted in a conducting high-voltage path and by means of which the high-voltage terminal of the high-voltage generator is electrically connected or connectable to the electric jumper.

4. The powder spray gun as claimed in claim 3, wherein said at least one current-limiting resistor is potted into an electrically insulating block which extends as far as the vicinity of the electric jumper.

5. The powder spray gun as claimed in claim 4, wherein at least a portion of the electric high-voltage generator together with said at least one current-limiting resistor are potted into the electrically insulating block which extends over said portion of the electric high-voltage generator and said at least one current-limiting resistor in continuous manner.

6. The powder spray gun as claimed in claim 5, wherein said at least one current-limiting resistor and the entire high-voltage generator are potted into the electrically insulating blocks;

the high-voltage generator containing at least one cascade circuit of electrical components to generate a high DC voltage from a high AC voltage and a transformer to generate the high AC voltage from a lower AC voltage.

7. The powder spray gun as claimed in claim 6, wherein the high-voltage generator further contains an oscillator potted into said block to generate the lower AC voltage from a lower DC voltage.

8. The powder spray gun as claimed in claim 5, wherein the electrically insulating block is potted into an integral, electrically insulating, ship-hull shaped half dish containing all the components potted into the block;

the half dish runs forward beyond the current-limiting resistor as far as the vicinity of the electric jumper; and the half dish is insertable from the rear end of the gun housing into the high-voltage chamber.

9. The powder spray gun as claimed in claim 8, wherein the half dish is configured at an end segment thereof in the form of a receiving duct to receive a rear end segment of an electrically conducting compression spring which is clamped or clampable, as seen in the longitudinal direction, between the jumper and a downstream electrical contact of the current-limiting resistor.

10. The powder spray gun as claimed in claim 1, wherein the integral gun housing surrounds the tubular powder-feed duct and comprises at least one further chamber; and said at least one further chamber extends from the rear, open end in the longitudinal direction to the front end and is sealed by the front end of the gun housing.

11. The powder spray gun as claimed in claim 2, wherein the integral gun housing surrounds the tubular powder-feed duct and comprises at least one further chamber, said at least one further chamber extends from the rear, open end in the longitudinal direction to the front end and is sealed by the front end of the gun housing; and said at least one further chamber comprises a compressed-gas duct which has a compressed-gas transmission aperture in the front end wall of said housing.

12. The powder spray gun as claimed in claim 10, wherein said at least one further chambers comprise four chambers including the high-voltage chamber; and said four chambers are regularly configured around the tubular powder-feed duct which is completely surrounded by the four chambers and partitions therebetween.

13. A spray gun, comprising an electrically insulating gun housing having, in a longitudinal direction of said gun, a rear end and a front end;

an interior of said housing comprising a coating material feed duct for conveying a coating material by a compressed gas and a high voltage chamber;

both said coating material feed duct and high voltage chamber extending in the longitudinal direction of said gun from the rear end to the front end of said housing;

said housing comprising at the front end thereof a transverse wall which hermetically seals said high voltage chamber from the coating material and compressed gas traveling in the coating material feed duct;

a high voltage generator received in said high voltage chamber;

a high voltage electrode positioned outside said high voltage chamber and adjacent a front end of said coating material feed duct for electrostatically charging the coating material; and an electrical conductor extending in a hermetical manner through said transverse wall and electrically connecting a high voltage output terminal of said high voltage generator and said high voltage electrode.

14. The spray gun as claimed in claim 13, further comprising a current limiting resistor disposed between and electrically connecting the high voltage output terminal of the high voltage generator and said conductor.

15. The spray gun as claimed in claim 14, wherein said current limiting resistor and at least a portion of said high voltage generator that includes the high voltage output terminal are potted together in an electrically insulating block.

16. The spray gun as claimed in claim 15, wherein said at least one current limiting resistor and the entire high voltage generator are potted in the electrically insulating block.

17. The spray gun as claimed in claim 16, wherein said high voltage generator comprises at least one cascade circuit of electrical components to generate a high DC voltage from a high AC voltage;

a transformer to generate the high AC voltage from a lower AC voltage; and an oscillator to generate the lower AC voltage from a lower DC voltage.

18. The spray gun as claimed in claim 15, wherein the electrically insulating block is insertable through the rear end of the gun housing into the high voltage chamber.

19. The spray gun as claimed in claim 15, further comprising an electrically conducting compression spring located within said high voltage chamber between a front end of said block and said conductor;

said spring being clampable, in the longitudinal direction of the gun, between the conductor and a downstream electrical contact of the current limiting resistor.

20. The spray gun as claimed in claim 13, wherein said coating material feed duct and said a high voltage chamber are separate by internal walls of said housing;

said internal walls further define in the interior of said housing at least one further chamber;

said at least one further chamber and said coating material feed duct open to an outside of said housing through respective openings in said transverse wall.

* * * * *